United States Patent [19]

Bascos

[11] 4,170,165

[45] Oct. 9, 1979

[54] SYSTEM FOR OPERATION OF GAS CONTROLLED DEVICES EMBODYING AN AUTOMATIC PROGRAMMABLE VALUE SEQUENCER ADAPTED TO CEASE OPERATION UPON THE OCCURRENCE OF A MALFUNCTION

[76] Inventor: Santiago A. Bascos, 3252 Dawson Dr., Warren, Mich. 48092

[21] Appl. No.: 735,193

[22] Filed: Oct. 26, 1976

[51] Int. Cl.[2] ..... F01B 25/26; F01B 31/12

[52] U.S. Cl. ..... 91/1; 74/129; 91/36; 91/37

[58] Field of Search ..... 91/36, 37, 410, 1; 74/129

[56] References Cited

U.S. PATENT DOCUMENTS

| | | | |
|---|---|---|---|
| 3,436,976 | 4/1969 | Frankel | 74/129 |
| 3,651,643 | 3/1972 | Hurrah | 92/1 |
| 3,657,964 | 4/1972 | Workman, Jr. | 91/1 |
| 3,900,090 | 8/1975 | Kobelt | 91/36 |
| 3,930,434 | 1/1976 | Hunter | 91/36 |
| 3,941,031 | 3/1976 | Haddenhorst | 91/37 |
| 3,972,246 | 8/1976 | Link | 91/37 |
| 4,004,497 | 1/1977 | Scholin | 91/37 |

*Primary Examiner*—Abraham Hershkovitz
*Attorney, Agent, or Firm*—Dolgorukov & Dolgorukov

[57] ABSTRACT

The specification discloses an automatic programmable valve sequencer employing a rotatable cam cylinder operating adjacent cam valves by means of cam segments mounted thereon to directly operate air cylinders or other air-operated tools.

While the cam cylinder is manually advanced between steps where such cylinders or other tools are to be actuated, if a particular program doesn't utilize all the steps available, by virtue of one cam cylinder in combination with several control valves being able to automatically advance the cam cylinder when programmed to do so, the valve programmer will advance past vacant steps to the start of the next programmed cycle immediately on completion of the previous one.

15 Claims, 14 Drawing Figures

| STEP | #1 VALVE | #2 VALVE | #3 VALVE |
|---|---|---|---|
| 1 | | | |
| 2 | | *—A | |
| 3 | | * | * |
| 4 | * | | |
| 5 | | | |
| 6 | | * | |
| 7 | | * | * |
| 8 | * | | |

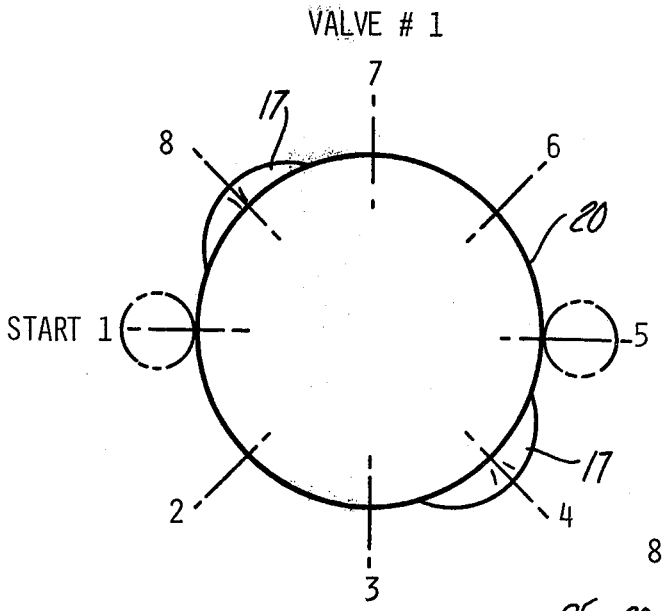
Fig-6
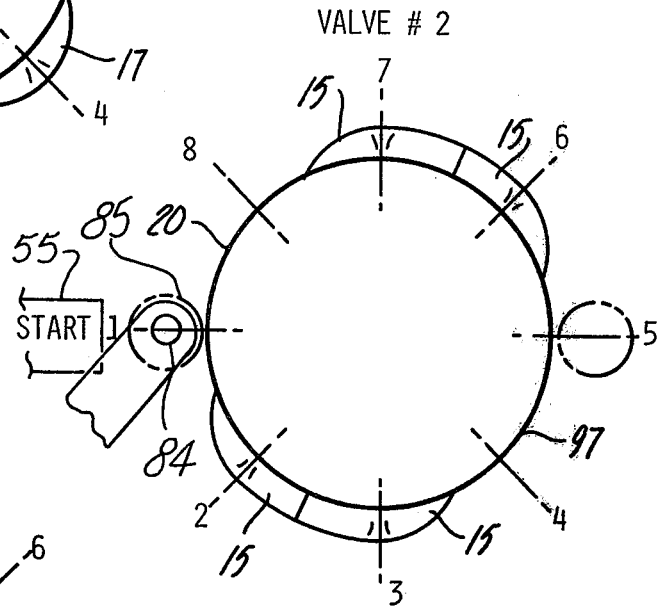
Fig-7
Fig-8
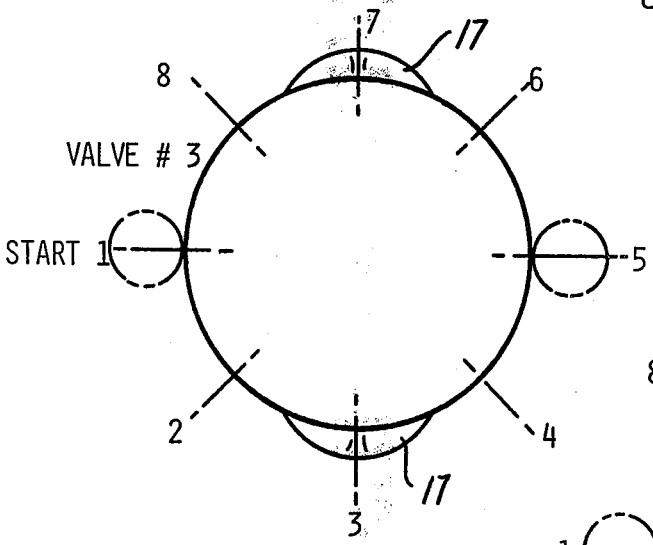
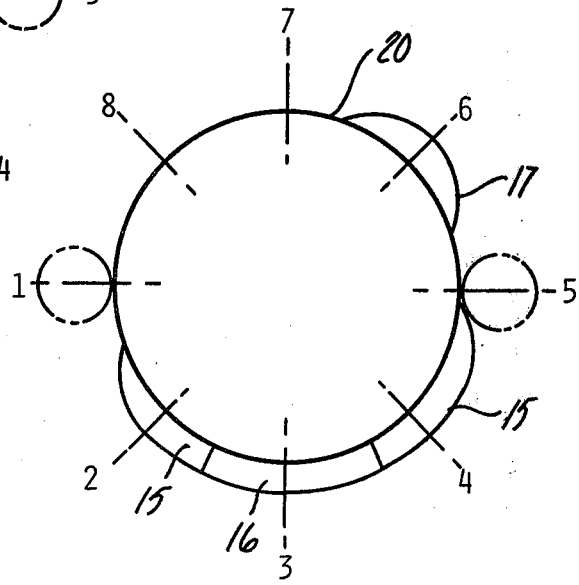
Fig-9

SYSTEM FOR OPERATION OF GAS CONTROLLED DEVICES EMBODYING AN AUTOMATIC PROGRAMMABLE VALUE SEQUENCER ADAPTED TO CEASE OPERATION UPON THE OCCURRENCE OF A MALFUNCTION

The present invention is concerned with a device to automatically operate valves which in turn operate air-operated machinery of many types such as air cylinders, air-operated clamps, drills, etc., and more particularly concerns an automatic programmable valve sequencer which automatically controls such valves.

Because of economy and reliability, many production operations in the modern factory are performed with air-operated machinery. In contrast to electrical machinery which in turned on and off by a switch, the air-operated machinery, such as a drill, air-operated clamp, etc., is turned on and off by an air valve. By the use of different types of air valves it has been found that air-operated machinery can be started and stopped in substantially the same manner as electrical equipment.

However, until the present time, such equipment has tended not to be automated to any degree because of the expense and bulk of the equipment presently available.

Because of such expense, many operations which could be automated have gone without automation. One such type of operation with which I am familiar is the type of production operation which involves the building up of subassemblies which are later installed in a completed article, whether it be an automobile, a machine tool, or any number of other devices. Many of the subassemblies are assembled in fixtures in which a part will be placed in the fixture and clamped down, another part may be placed on top of the first part and in turn clamped down, and the parts may be welded or screwed together, and such operations may be repeated as many times as necessary until the completed subassembly is made.

At the present time, because of the aforementioned expense, most of the clamping operations are done entirely using hand clamps together with some air-operated power clamps. A worker may put a part in the fixture, or for example in larger assemblies, two more workers might put one part in the fixture and push appropriate buttons to actuate power clamps to hold the part. Another part may be put on top of the first part and hand clamps used for these, and a welding operation, for example, may take place. Hand clamps in general will be used for all of the smaller parts. This results in a very tiring operation for the workers, as for an entire eight hour shift, with only ten to fifteen minute breaks every hour, the hand clamping operation is very tiring. Because of this tiring effect, often a clamp or two is not closed, and parts will shift or become dislocated during the manufacture of the subassembly, with the result being a rejected subassembly, which is very costly.

Until now, although it has been known that replacing many of the hand clamps with air-operated clamps in the smaller operations would eliminate much of this tiring effect and increase productivity, no practical way has been found to do this. Although it has been tried to merely set up and replace the hand clamps with air-operated clamps wherever needed, it has been found that the control problem becomes very critical, and also a safety problem is introduced.

For example, if a particular sequencing of clamps is needed for proper assembly work, how is one to make sure that the worker will repetitively, time after time, clamp the clamps in the right sequence, or, if more than one worker is involved, how can these two workers be coordinated time after time. Further with many workers working independently, a real safety problem is introduced as it is very possible that a worker may be holding a part, while another worker is operating a clamp assembly with resultant injuries to the worker.

This problem has been long standing in the industry, and I am aware of some attempts to solve it, all of which have been unsuccessful. One such attempt involved setting up an elaborate interlock system while maintaining the workers as the individual operators, but such system provided to be too costly to implement.

Another system involved the use of remotely operated air valves to power the clamps, with a cam assembly operating microswitches, which in turn operated the larger air valves, which in turn operated the air cylinders. However, this proved to be costly because of the need of intermediate micro-switches and air cylinders, and also proved to be not completely reliable, and thus, until the present day, there was no satisfactory solution for the problem of how to automate subassembly operations, where a large amount of human labor is still needed, in a simple, reliable, and inexpensive way.

Thus, one of the objects of the present invention is to provide a device capable of the automatic sequencing of power clamps or other air-operated machinery in subassembly or assembly operations.

A further object of the present invention is to provide an automatic programmable valve sequencer of the above nature which provides manual override and positive interlocks so that it is safe in operation.

A further object of the present invention is to provide an automatic programmable valve sequencer having a means to reverse the motion of the cam assembly operating the air valves so that in case any of the cylinders or machines being operated by the valve sequencer jam, the motion may be reversed to withdraw the jammed air cylinder or other device without damaging the sequencer or injuring the worker.

A still further object of the present invention is to provide an automatic programmable valve sequencer having a manual override for set up and maintenance purposes.

A still further object of the present invention is to provide an automatic programmable valve sequencer of the above nature which eliminates the need for microswitches, provides for direct cam operation of air-operated cylinders or other machinery, and thus provides a greatly simplified construction.

Another object of the present invention is to provide a valve sequencer manufactured substantially from standard available items to keep the overall cost low and to make it economical to automate operations using said programmer.

A further object of the present invention is to provide for cams to operate any practicable number of air valves to automatically sequence any practicable number of air-operated cylinders.

A futher object of the present invention is to provide for an automatic programmable valve sequencer which is relatively simple and inexpensive to manufacture and reliable in operation.

Further objects and advantages of the present invention will be apparent with reference to the following description and appended claims, reference being had to the accompanying drawings, wherein like reference characters designate corresponding parts in the several views.

FIG. 6 is a plan view of the portion of the cam cylinder adjacent the first cam valve of a construction embodying the present invention at its first, or start, position showing the operating cams attached thereto in position 3 and 7 as shown on the chart in FIG. 2.

FIG. 7 is a plan view of the cam cylinder portion of the present invention immediately adjacent to a second cam valve shown at its start, or number one, position corresponding to step 1 on the chart shown in FIG. 2.

FIG. 8 is a plan view of the cam cylinder portion of an embodiment of the present invention immediately adjacent to a third cam valve shown at its start, or number one, position corresponding to step 1 on the chart shown in FIG. 4.

FIG. 9 is a generalized illustration of the portion of the cam cylinder which may be adjacent to any of the cam valves, and showing a program set up with one of each of the three different cam segments used in my construction.

Figures 1, 2:
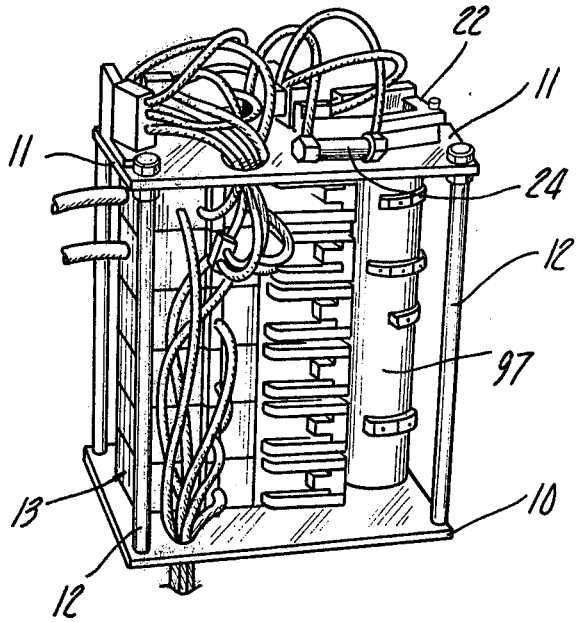
FIG. 1 is a perspective view of a construction embodying the present invention.
FIG. 2 is a chart showing a valve operating sequence which can be programmed into the construction shown in FIG. 1.

It should be understood that my invention is not limited in its application to the details of construction or arrangement of parts illustrated in the accompanying drawings, since the invention is capable of other embodiments and of being practiced or carried out in various ways within the scope of the claims. Also, it is to be understood that the phraseology and terminology employed herein is for the purpose of description, and not of limitation.

In general, my automatic sequenceable valve programmer consists of a frame composed of a bottom plate 10, and a top plate 11, held together by threaded rods 12 on three corners, a valve manifold assembly, generally designated by the numeral 13, is at the fourth corner. Cam operated valves such as the first cam valve 54, the second cam valve 55, and the third cam valve 56 may be mounted on the manifold. These valves are activated by cam segments, such as number 15, 16 and 17, fastened on a rotating cam cylinder 97. Aside from the bottom and top plate and the cam segments, the cam cylinder is the only part that requires close machining.

The cam cylinder 97 has a hexagonal shaft 21 extending through the top plate 11 with the shaft rotating in suitable bushings (not shown). A reversible ratcheting clutch assembly generally designated by the numeral 22, which may be one similar to Model No. 71-312 manufactured by the Lowell Corporation of Worcester, Mass., with a matching hexagonal hole 23 is slipped over the cam cylinder shaft. This ratchet clutch plays a key role in the valve program.

A double-acting reversing cylinder 24 is connected to the ratchet clutch. For every stroke of the cylinder, the cam cylinder 97 indexes 45 degrees. Obviously then eight strokes of the double-acting reversing cylinder 24 are needed to complete one revolution.

A novel feature of the present invention is that any practicable number of air cylinders or machines can be programmed, and these can be sequenced over any practicable number of steps. One is not limited to sequencing over eight programmable steps for each revolution, nor is one limited to any certain number of valves, although one must of course be sequencing at least one valve or tool, and thus have two cam valves for the present invention to operate. One valve to operate a power clamp or the like, and one valve for the automatic indexing feature of my invention.

Because of this great versatility, it is simply impossible to describe all possible programs for my vavle sequencer, or all possible embodiments. Therefore, for purposes of disclosure, I have chosen to describe an embodiment which it is felt will meet the needs of most users. This involves a cam cylinder and three cam shapes capable of giving eight programmable steps for each revolution for each cam valve, with eight cam valves being shown, For ease of illustration, a program which involves three steps and three valves, which by virtue of the eight step sequencing can be completed twice in each cycle (revolution) of the cam cylinder is discussed.

Figure 4:
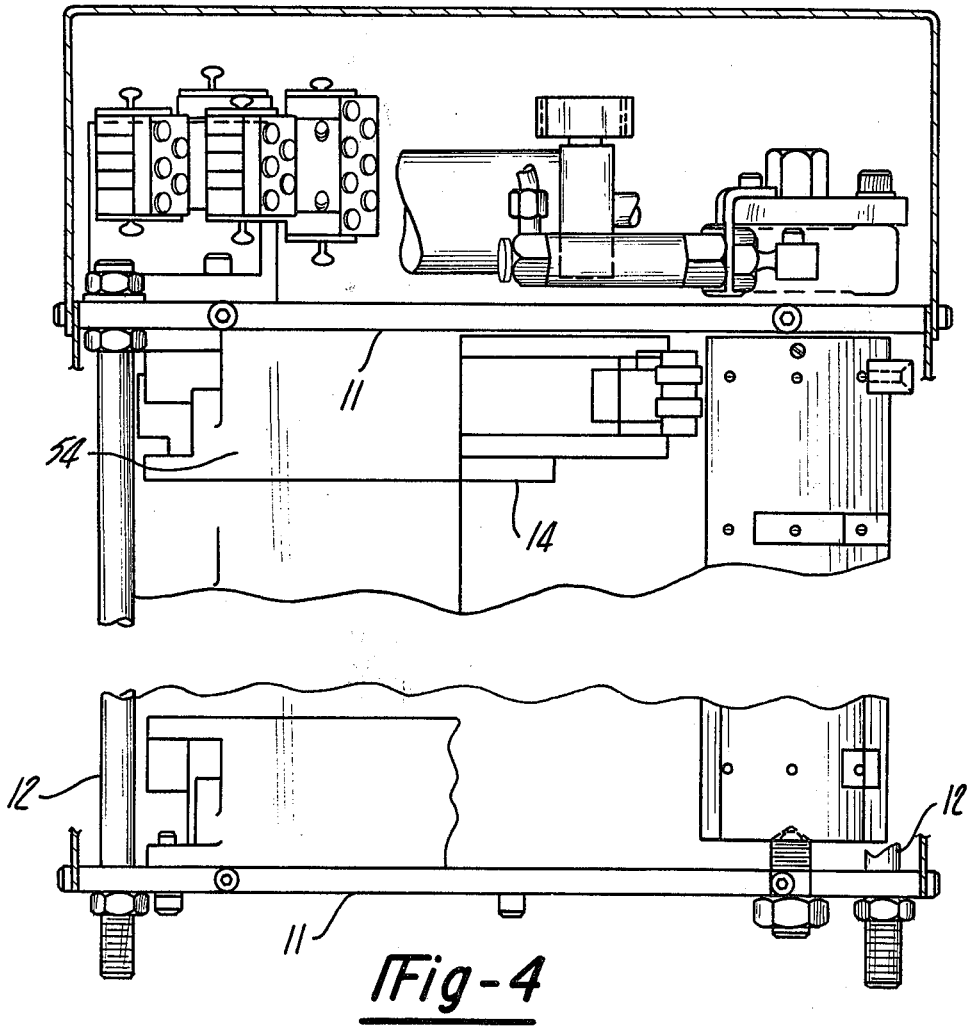
FIG. 4 is an elevational view of the automatic programmable valve sequencer shown in FIG. 3.

Since the illustrated sequence, as shown in FIG. 4, needs only three steps, and is repeated once, there are two steps left over in the complete one full revolution of the cam cylinder. To take care of left over steps, an automatic index feature is incorporated in the circuitry. A first cam valve 54 will be actuated for automatic indexing to take up the left over steps, and this will bring the cam cylinder 97 to the start position.

Actuating the first cam valve 54 on step 4 and step 8 will leave step 1 and step 5 for load and unload, or start, position. By using the automatic index feature it will not be necessary to push the buttons on first or second operator valves 69 or 70 to bring the programmer to a start position. Using the three cam segments 15, 16 and 17, or any combination thereof, the valve sequencer can be programmed or reprogrammed any time. FIGS. 6, 7 and 8 show the cams associated with each cam valve.

For a description of the actual program illustrated, a reference to FIG. 2 shows a step chart illustrating a particular sequence of valve operations. The asterisk in any particular position indicates when a particular cam valve is in operation and on which step. For example, the asterisk indicated by the letter A indicates that the number 2 valve is actuated on step 2.

The particular chart in FIG. 2 could apply to a number of different operations in its present form, and it is obvious that an unlimited number of different charts could be used for the purpose of description, having any number of valves and any number of steps. However, the particular chart in this case is used to illustrate a sequence of operations wherein step 1 illustrates the loading of a part into a subassembly fixture. Step 2 indicates that an operator has pushed a certain actuating button and the cylinder operated by second cam valve 55 have actuated to hold a part firmly in place. Step 3 shows the actuation of the third cam valve which serves to actuate another cylinder to hold another part which has been loaded in the fixture. At this time, for example, a welding operation could take place.

After the subassembly is completed, as indicated by the completion of step number 3, the operator pushing the buttons associated with the first and second operator valves 69 and 70 will advance to step 4 which will, in turn, actuate the automatic indexing by actuating the first cam valve 54, and will advance the cam cylinder 97 to step 5 automatically where all parts are released and the sequence is ready to repeat itself.

To program my valve sequencer for this sequence of steps, the set up man will fasten the cam seqments 15, 16 and 17 on the cam cylinder 97 in the appropriate position as called for in FIG. 2 adjacent the first cam valve 54, the second cam valve 55, and the third cam valve 56 which, in turn, are connected to operate the automatic indexing feature, the cylinders 57 and 58, and the cylinders 59 and 60 respectively. My automatic programmable valve sequencer would then be connected to a suitable air supply generally designated by the number 50.

Another novel feature of my invention is the fact that the valves used do not require critical filtration. The system illustrated in a general fashion in FIG. 5 can take air particles up to 50 microns in diameter with no effect, so that only one air supply is needed for the power valves and the programmer. The air will enter the device from an air supply and enter the filter-regulator-lubricator assembly, generally designated by the numeral 50, consisting of a filter 51, the regulator 52, and the lubricator 53. From the filter-regulator-lubricator assembly 50 it will pass by means of conduit 49 into the supply side of an on-off valve 36. As the air supply exhausts from the on-off valve 36, it is supplied by means of a primary supply conduit generally designated by the numeral 37 to the supply side of manifold 14, the second cam valve 55 and the third cam valve 56 and the master operators box and the number two operators boxes, generally designated by the numerals 18 and 19 respectively, in preparation for future operation.

An advantage of my system is that only one man is needed to sequence the system for checking it out, and also for maintenance purposes. With the number two and number three operator's boxes 19 and 20 on bypass mode the system can be sequenced by the master operator's box 18. The system can be more easily understood by now referring to FIGS. 5A–5E having air paths for particular positions of the valves to be discussed below shown in heavy black lines.

To start the cycle, as previously described, the operator would first select the forward or reverse direction by means of the reversing valve 25. The operation of this valve will be described in detail herein. The operator next actuates the mechanism by pushing the push buttons on the first operator valve 69 and the second operator valve 70. The condition of the system immediately before depressing the first operator valve 69 and the second operator valve 70 is shown in FIG. 5A, with the air path shown in heavy black lines as previous indicated. It is to be noted that the operator number two and operator number three boxes 19 and 20 are in bypass mode. The system immediately after the operator buttons 69 and 70 are pushed, is shown in FIG. 5B. This, in turn, lets air enter the first and second supply inlets, indicated by the small numerals 1 and 2, of the valve 69, exhaust through the first and second exhaust outlets (also indicated by small numerals 1 and 2) similarly enter and pass through valve 70, through the third master operator valve 71 and the fourth master operator valve 72, through the first cam valve 54, and enter the first indexing valve 27. This valve is a spring return single-pilot operated four-way valve such as Model No. KV8-5044 manufactured by Kay Pheumatics of Alpena, Mich. The air entering the supply inlet 1 of the indexing valve 27 actuates the valve which, in turn, will allow the air to pass through the second exhaust outlet thereof into the supply inlet of the second index valve 28 into the blind end of indexing cylinder 35. The valve 28 is a double-pilot operated four-way valve such as Model No. KV9-5044 manufactured by Kay Pneumatics.

Upon actuation of the indexing cylinder 35, and upon extension of the cylinder shaft 81 by the cylinder 35, the indexing arm 82, which is fastened to the ratchet assembly 22 by appropriate fastening means 83, indexes the shaft 21, 45 degrees. Upon the cylinder shaft 81 reaching its full extended position, since the first operator valve 69 and the second operator valve 70 are spring loaded, they will automatically return to their first position upon release. This will cause a loss of air pressure entering the inlet of the first indexing valve 27, causing it to return to its original position, which will then direct the air pressure through the first exhaust outlet of valve 27, into the first supply inlet of second indexing valve 28 and out the first exhaust outlet thereof to the rod end of the indexing cylinder 35, causing it to return to its original position. By virtue of the action of the ratchet assembly 22, however, the hexagonal shaft 23 will not rotate.

It should be understood that the third master operator and number two operators valves are three-way pilot-operated valves such as Model No. KV9-3-044 manufactured by Kay Pneumatics, while the fourth master operator and number two operator valves are four-way pilot-operated valves such as manufactured by Kay Pneumatics, Model No. KV51-5-044.

We are now at the step labeled No. 2 on our chart (FIG. 2), and if any of the cam valves are set to be actuated, as is the No. 2 valve in our example, at this stage the cam follower 85 mounted on the shaft 84 of the second cam valve 55 will contact the cam 15 and the valve will be shifted to its on position, allowing the air which normally passed through the cam valve in its off position and entered the rod end of the cylinders 57 and 58 to now enter the blind end of the same cylinder, causing the extension of the cylinder shaft. This operational step is shown in FIG. 5C. In our drawing of FIG. 5, there is nothing shown connected to the shafts, as the actual connections depend on the particular application to which the present invention is put. It is also obvious that two cylinders need not be connected to cam valve No. 2, but that one cylinder, two cylinders or any practicable number of cylinders or devices could be connected depending on the particular application.

To ensure the proper operation of my programmable valve sequencer, limit valves similar to Model No. KV67-5-044 manufactured by Kay Pneumatics in the form of a first limit valve 61 and a second limit valve 62 are provided for the cylinders 57 and 58 respectively. When the cylinders 57 and 58 are operating normally and there is nothing amiss in the operation in which they are performing, the shafts related to those cylinders will extend to their full position, shifting the limit valves 61 and 62 from their normally off position, to their on position, allowing the air supplied to them through conduits 46 and 47 respectively to pass through conduit 34 to the first indicating device 90 and indicate that their first pair of cylinders 57 and 58 are operating in the proper manner, as shown in FIG. 5C.

Figure 5:
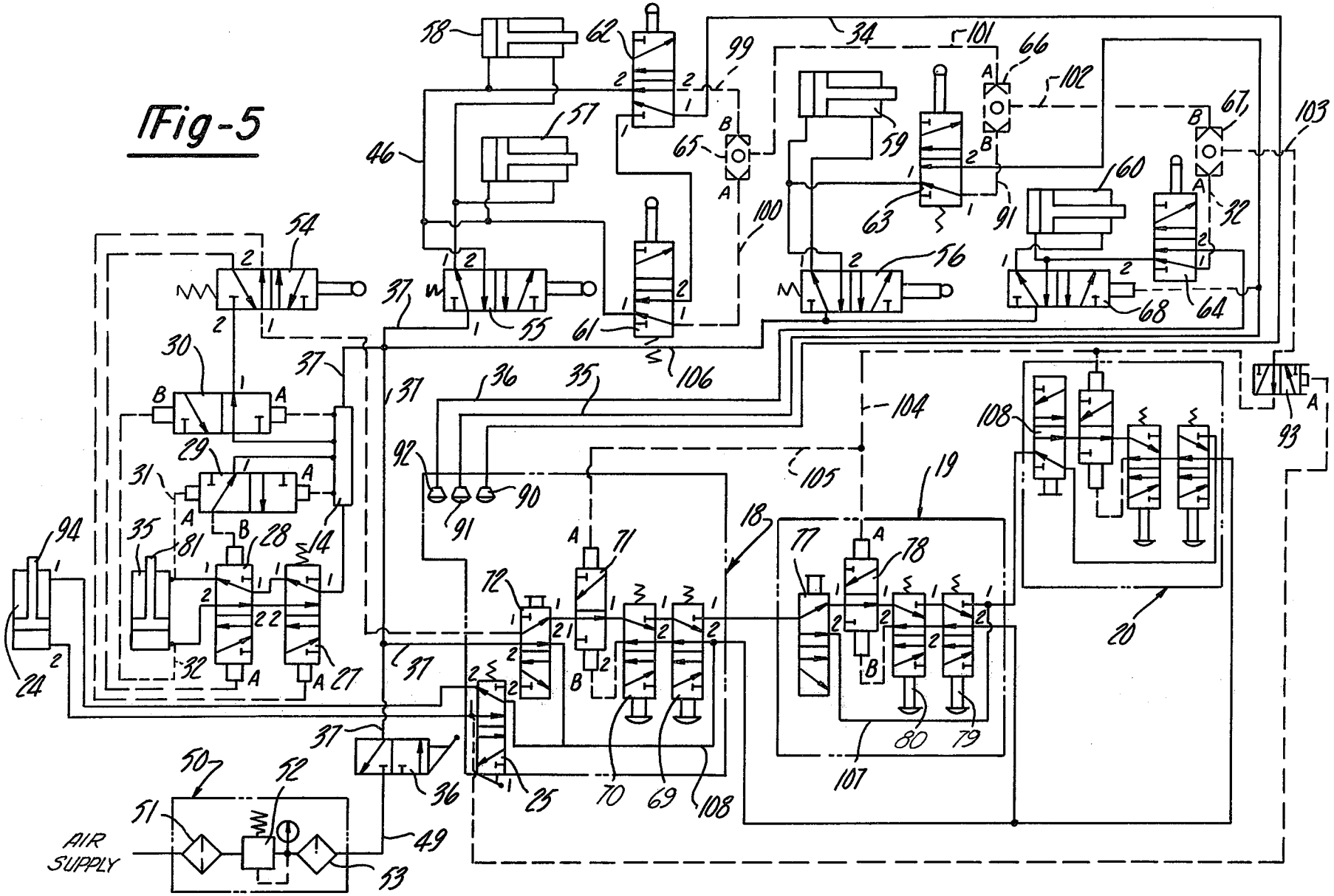
FIG. 5 is a schematic view of the construction illustrated in FIG. 1.
Figure 5A:
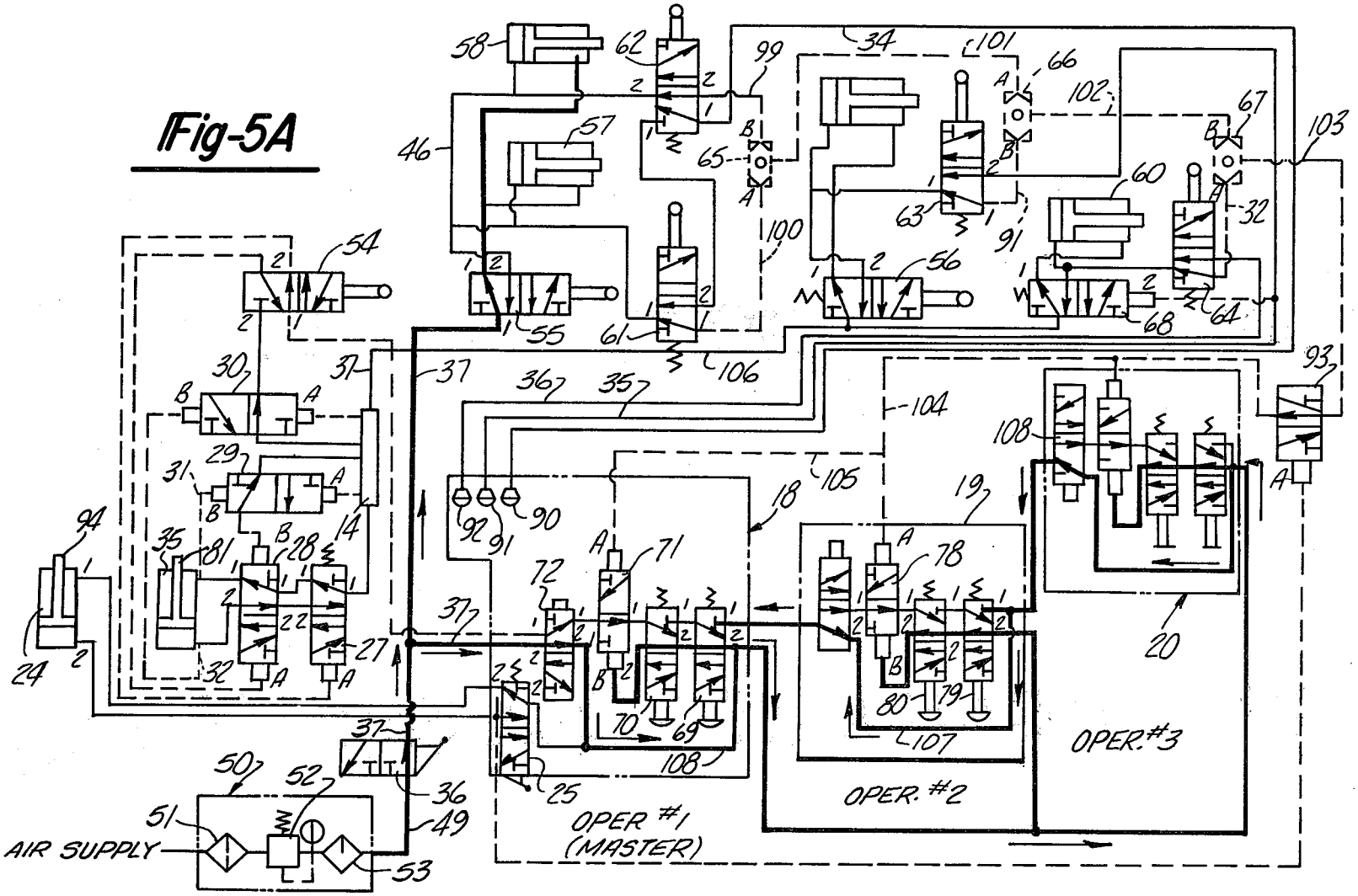
FIG. 5A is a schematic view similar to that shown in FIG. 5, and showing in heavy darkened lines the condition of the system immediately before depressing the first and second operator valves.
Figure 5B:
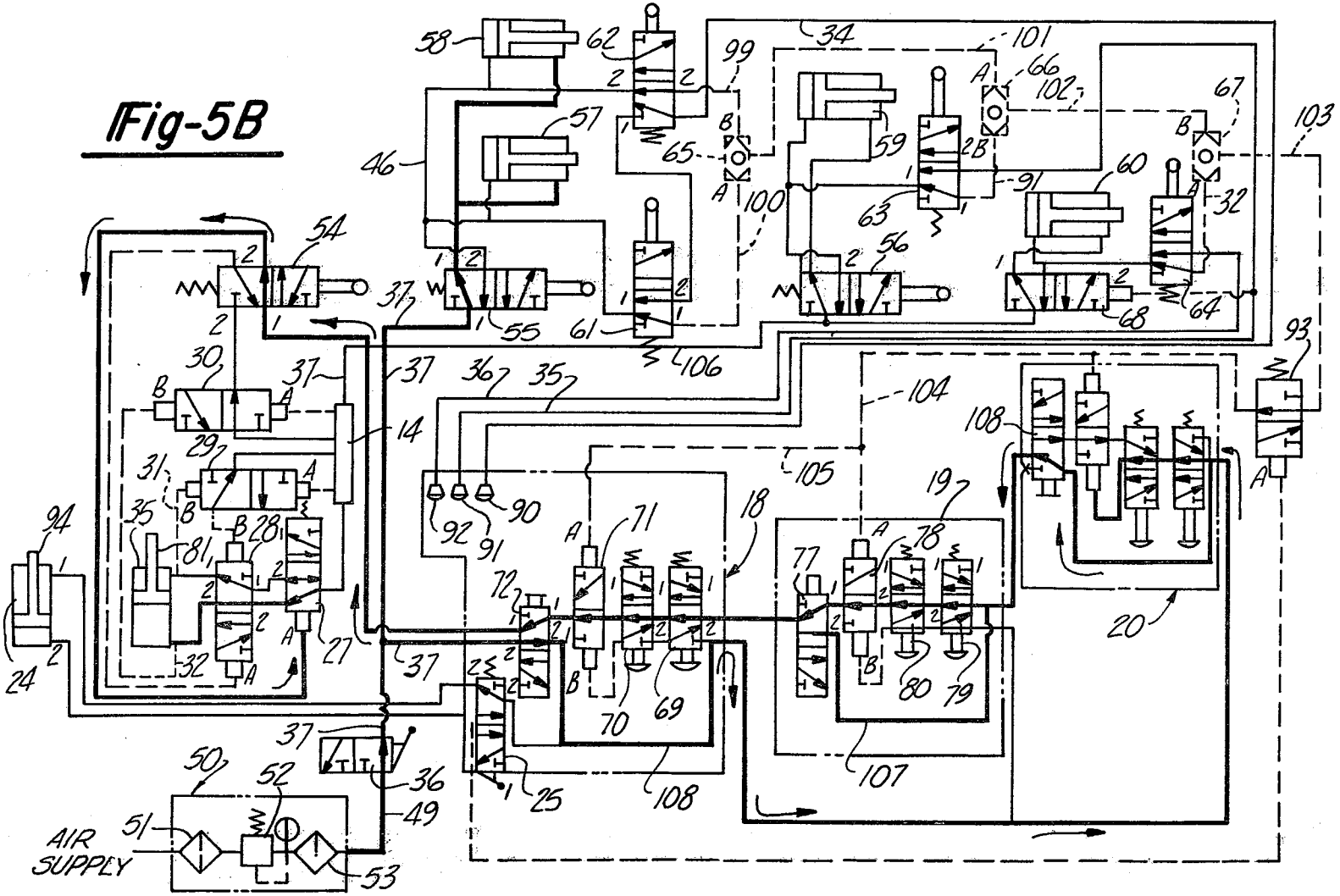
FIG. 5B is a schematic diagram showing the condition of the system immediately after depressing the operator valves.
Figure 5C:
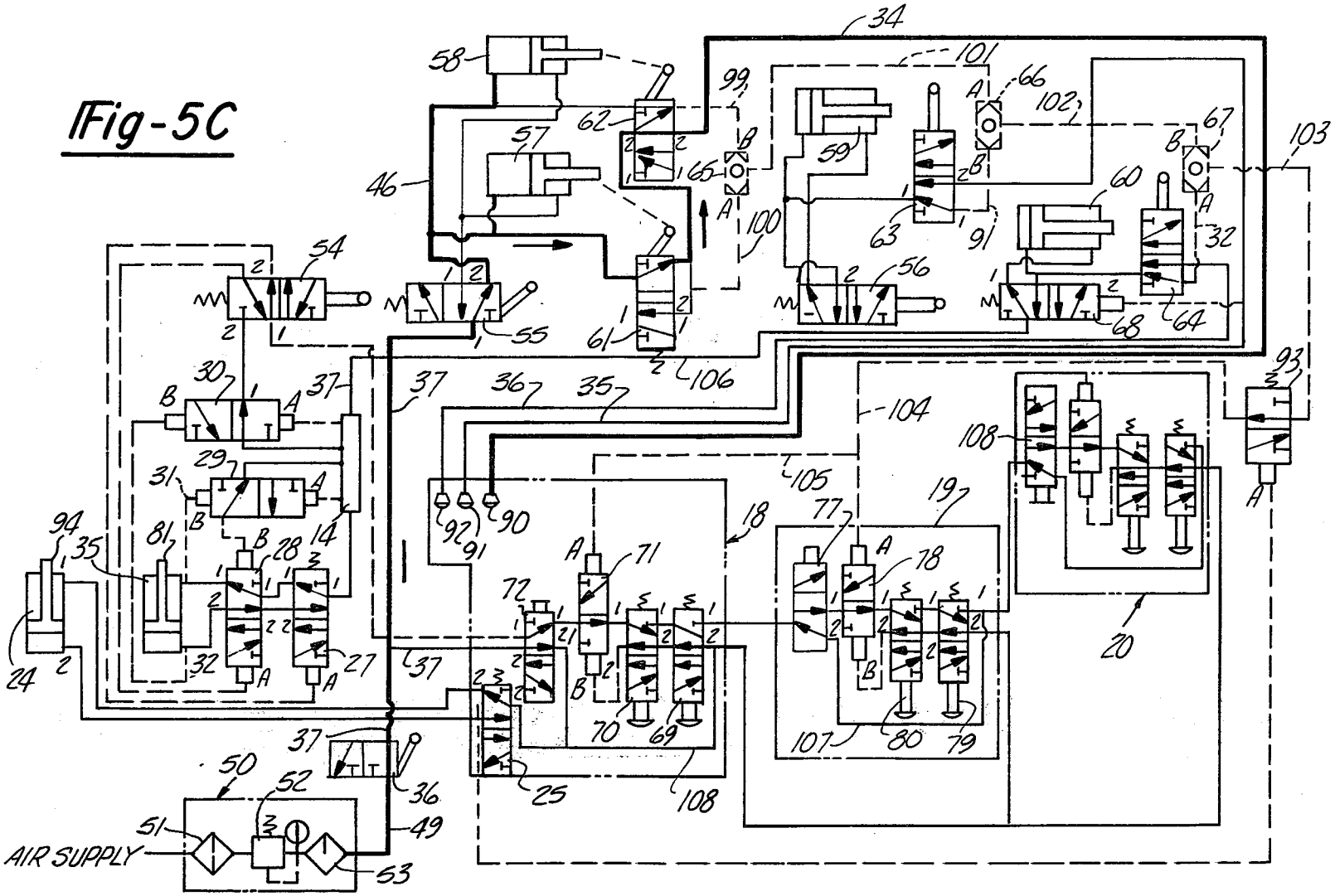
FIG. 5C is a view similar to FIG. 5, and showing the condition of the system after the number 2 cam valve is actuated.
Figure 5D:
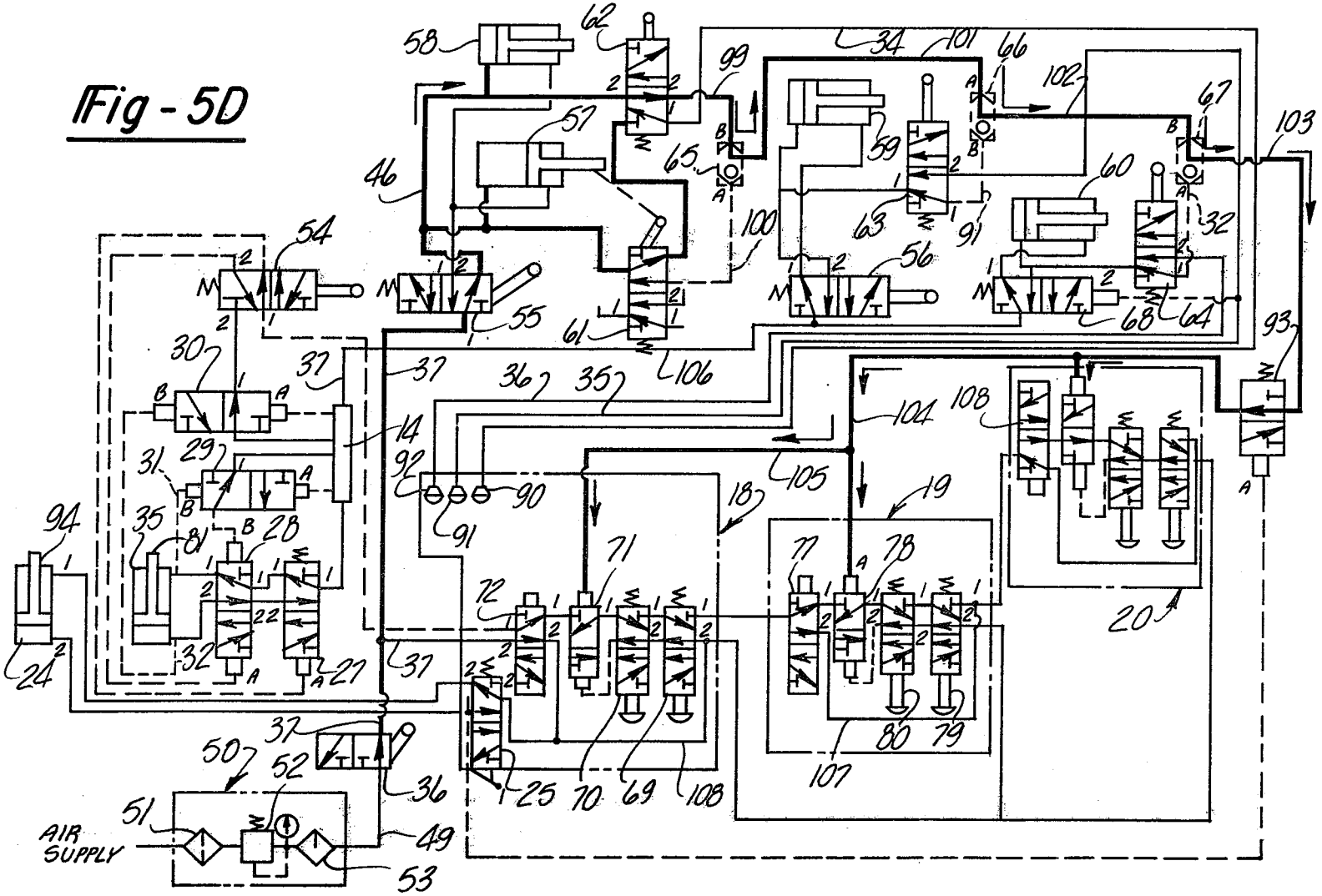
FIG. 5D is a schematic diagram, similar in large part to FIG. 5, but showing the air flow path which occurs (in heavy black lines) in any of the cylinders in the system are not operating in a proper manner.

However as shown in FIG. 5D, if these cylinders do not extend to their full length, the first limit valve 61 and the second limit valve 62 will not be shifted to their on position and in this case the air will pass through the appropriate exhaust outlets of the valves, conduit 99, through the B input of first shuttle valve 65, through the exhaust side of said valve, conduit 101, similarly through second shuttle valve 66, conduit 102, third shuttle valve 67, conduit 103, and dumping valve 93 which may be of the same type as first indexing valve 27, and enter the pilot end A of the third master operator valve 71, as well as the third number two operator valve 78, and additional corresponding operator's valves depending on the number of operator's stations. With these valves shifted to their on position, it is clear that any attempt to further operate the valve sequencer by again operating the first and second operator valves 69 and 70 associated with the master operator box 18, or 79 and 80 associated with the number two operator box 19, or indeed an attempt to operate similar valves in any operator's box such as the one generally designated by the numeral 20, will be futile because air passing through the first and second master operator valves 69 and 70, for example, will be blocked from passing through the third master operator valve 71, and the fourth master operator valve 72, and therefore one cannot further index the system.

Figure 5E:
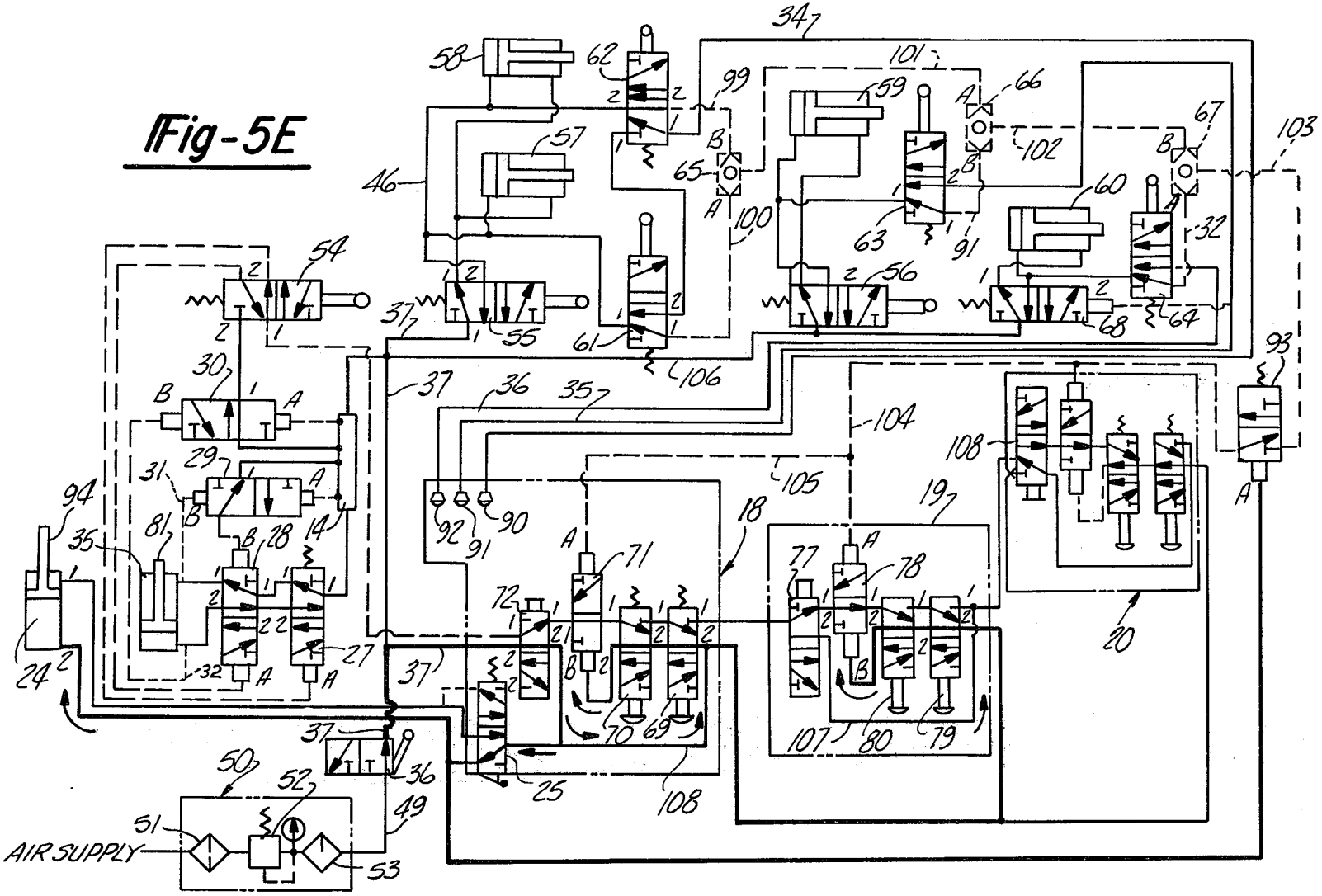
FIG. 5E is a view similar to that shown in FIG. 5D, but showing the air path which would occur upon making an attempt to clear any blockage in the system.

Referring now to FIG. 5E, the first attempt to clear the cause of the jam of the machine preventing the cylinders 57 and 58 from reaching their full extension will be to attempt to reverse the ratcheting mechanism 22 to deactivate the second cam valve 55, which would then again supply air to the opposite side (rod) of cylinders 57 and 58 causing them to retract. To accomplish this, the operator would shift the reversing valve 25 into its reverse position, which would cause the air entering the second supply inlet of the valve to now exit via the first exhaust outlet and enter the opposite side of the double-acting reversing cylinder 24. At this point the reversing cylinder shaft 94 will extend, carrying with it the clevis 95, which is attached by suitable fastening means to the reversing lever 96 of the ratchet assembly 22, causing the ratchet assembly to rotate the shaft in the opposite direction, returning it to its position immediately previous to the attempt at indexing the shaft 23. To return the reversing assembly to its normal position, it is necessary for the operator to manually move the reversing valve 25 back to its normally off, or forward position, at which time the reversing cylinder shaft 94 will again retract.

At this time, the operator by means of the indicators (90, 91 and 92) will know which operation is not proceeding correctly, and will go and attempt to clear the difficulty. Upon clearing the difficulty, operating the dumping valve 93 will return valves 71 and 78 to their normal position.

If everything is operating normally, however, we will next proceed past step 2 to step 3 on our chart. To go to step 3 on the chart it will now be necessary for the operator, whether it be the master operator, the master operator and a number 2 operator, or both of these and a number 3 operator to push the respective valves 69, 70, 79 and 80, and possibly others, which will now cause the cylinder to index in a manner similar to that previously described, by permitting the air pressure entering the master operator and other operator boxes to pass through the first and second master operator valves 69 and 70 when they are in their on position, through the third and fourth master operator valves 71 and 72, pass through the first supply inlet of the first cam valve 54 which is still in its normally off position, and activate the first indexing valve 27, which then allows air to pass through the second indexing valve 28 in a manner similar to that previously described into the indexing cylinder 35, which again extends the shaft 81, which activates the indexing arm 82 attached to the ratchet assembly 22 and activates the shaft 23 and rotates it an additional 45 degrees which causes the cam cylinder to also rotate 45 degrees.

We are now at step 3 on our chart, and because of the particular arrangement of the cams, the number 2 cam valve will be actuated in the manner just described and the number 3 cam valve will now be shifted by means of the cam 17, as shown in FIG. 5, to its normally on position. This will now let air go through the primary conduit 37 and enter the blind end of the number three cylinder 59, extending the cylinder shaft to its full length at which time, in the manner previously described, the third limit valve 63 will be shifted to its on position, causing the air to enter the first supply inlet and exit via the second exhaust outlet thereof and pass through the valve, enter the conduit 35, pass through this conduit, and activate the second indicating device 91, indicating to the operator that the third cylinder 59, and the operation associated therewith is operating properly.

Again, if it was not operating properly, and did not extend to its full length, the air would bypass the cylinder and enter the first supply inlet of the third limit valve 63, which would remain in its normally off position causing air to exit via the first exhaust outlet and enter the conduit 91, pass through the second shuttle valve 66, conduit 102, third shuttle valve 67 through the conduit 103, dumping valve 93, conduits 104 and 105 to again actuate the appropriate valves 78 and 71, and possibly others to block further operation of the system, at which time the operator, as described, may reverse the mechanism to retract the cylinder and then may go and clear the cause of the malfunction.

A modification of my invention allows for one cam valve to operate a number of cylinders in sequence merely by the addition of some additional limit valves and power valves. If, for example, the sequence calls for operating the cylinder 59 until its operation is completed, which would be indicated by its shaft reaching its full extension and shifting the third limit valve 63 to its normally open position, by the addition of a power valve 68 such as Model No. 37-910-40 manufactured by Kay Pneumatics, which is connected to the air supply, such operation is achieved. Supplying air pressure to the first supply inlet of power valve 68, which is spring loaded, causes the valve to shift to its on position, allowing air pressure to exhaust from the second exhaust outlet and enter the blind end of the third cylinder 60. In this case the cylinder 59 will remain extended while the cylinder 60 is extending and when the cylinder 60 reaches its full operation the fourth limit valve 64 will be shifted to its on position, allowing air pressure to pass through the conduit 106 and enter the indicating device 92 to indicate to the operator that cylinders 59 and 60 are operating normally.

At this point then, we are at the conclusion of step 3 on our chart, with the cylinders 57, 58, 59 and 60 fully extended. It is now desired, as shown by step 4 on our chart, to end the cycle, to reverse the direction of all the cylinders, and to fully retract them. To do this we must arrive at step 4 of the cycle, and this is done by the operator again pushing the appropriate push buttons allowing air to pass through the first and second master operator valves (69 and 70) and the first and second number two operator valves (79 and 80) and therethrough the third and fourth master valves (78 and 77) as previously described, and to then pass through the first cam valve 54 to enter the pilot end A of first index valve 27 to shift to its on position, which lets air supplied to said valve by manifold 14 enter the second supply inlet of the second indexing valve 23 while in its off position, pass through exiting via the second exhaust outlet and enter the blind end of indexing cylinder 35, causing shaft 81 to extend, indexing said cam cylinder 97 forty-five degrees.

However, when this step occurs it will be noted that the second and third cam valves are no longer being forced inward by the cams 17 and 15, as shown in FIGS. 6 and 7, and will now shift back to their normally off position allowing air to enter the rod sides of cylinders 57, 58, 59 and 60, causing them to fully retract. While this is occurring, the first cam valve 54 is shifted to its open position, which now causes air to exit via the second exhaust outlet thereof and apply pressure to the pilot end A of the second indexing valve 28 shifting it to its normally on position, causing the air entering said second index valve 28 via the first supply inlet from the first indexing valve 27 to be rerouted to the rod end of indexing cylinder 35, causing it to retract.

With the shifting of the first cam valve 54 into its on position by the cam 17, several things begin to happen simultaneously to achieve the automatic indexing function of my invention. It will be noted that air from the primary conduit 37 is normally entering the pilot ends A of the third and fourth indexing valves 29 and 30 which are also three-way double pilot operated valves, such as Model No. KV19-3-044 manufactured by Kay Pneumatics respectively, and is also being supplied to the supply input of those same valves by manifold 14. With the shifting of the first cam valve 54 into its on position, the air normally entering the first supply inlet of said valve is blocked, and in its stead, air entering the supply inlet of the fourth indexing valve 30 is allowed to exhaust from that valve, enter the second supply inlet of first cam valve 54, exit via the second exhaust outlet of said valve and enter the pilot end A of the second indexing valve 28, shifting it to its on position, and allowing the air exhausting through the first exhaust outlet of said first indexing valve 27 to enter the first supply inlet of valve 28 and exit via the second exhaust outlet of said valve to enter the blind end of indexing cylinder 35 and to extend its shaft 81. It will be noted that in addition to extending said shaft air is also passing through another conduit 32 to the pilot end B of the fourth indexing valve 30. Since such fourth indexing valve is a differential valve, the pilot end B has an area twice that of pilot A and this will cause the fourth indexing valve 30 to shift to its normally on position, blocking the flow of air to the second supply inlet of cam valve 54 and causing an immediate loss of pressure at pilot end A of second indexing valve 28, causing the valve to immediately shift to its normally off position, in turn causing air entering the first supply inlet to exhaust via the first exhaust outlet of said valve to the rod end of cylinder 35 and begin to retract it. As this is being retracted, air in addition to entering the rod end of the cylinder, is also entering the pilot end A of the third indexing valve 29 through conduit 31, causing it to shift to its on position, and allowing air entering the first supply inlet from manifold 14 to enter pilot end B of valve 28, again shifting it to its normally off position since the flow of air to pilot end A has been temporarily blocked by the shifting of the fourth valve 30 to its on position. This allows the retraction of indexing cylinder 35 to continue. However, the loss of pressure at the blind end of cylinder 35, and consequently at pilot end B of the fourth indexing valve 30 allows it to shift to its normally closed position, again letting air from primary conduit 37 pass through first cam valve 54 as previously described shifting second indexing valve 28 to its on position setting the stage for indexing cylinder 35 to again expand the shaft 81.

Figure 3:
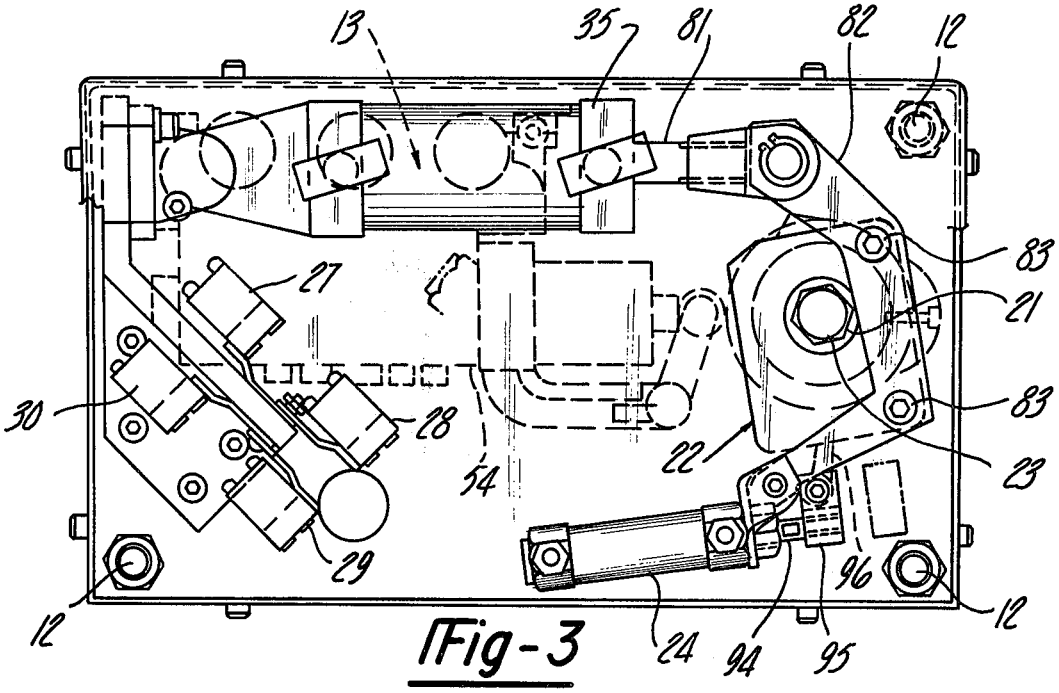
FIG. 3 is a top plan view of an automatic programmable valve sequencer embodying the construction of the present invention.

It can now been seen that as long as the first cam valve 54 is actuated, the indexing cylinder will continue shifting back and forth until the cam cylinder 97 is rotated to a position where there is no longer a cam 17 actuating the first cam valve 54, at which time the indexing motion is stopped. However, if as shown in FIG. 3 there is only a cam in one position, followed by a blank spot on the cylinder 97 for a number of positions, this indexing motion will stop, and we will arrive at the next step on our chart, which will be the second start position indicated by position 4 on FIGS. 4–6. At this time, due to our particular example, we would then go through an identical sequence of steps to that just described, passing through steps 6 and 7 and arriving at step 8, where the first cam valve 54 is again actuated, and the cylinder would automatically index to step 1, beginning a new sequence of steps as just described. It is obvious that if a different sequence of steps were used, for example a sequence which required six steps and then had to automatically index, additional cam segments could be mounted at the appropriate position on the cam cylinder 97 opposite the first cam valve 54 to actuate the cam valve upon entering into step 7, at which the cam cylinder 97 would automatically index twice to arrive at the beginning of another sequence of steps.

Little has been said to this point about the fourth master operator's valve 72, and the fourth number two operator's valve 77, except to say that they are shown in their normally closed position so that air simply passes through them at all times. However, it will be noted that they are also bypass valves, enabling one to bypass the master operator's box 18 or the number two operator's box 19, or any combination desired for the purposes of set up, etc. For purpose of description, it can be seen that conduits 106 and 107 bypass the first, second and third number two operator's valve and the first, second and third master operator's valve numbers 78, 79, 80 and 69, 70 and 71 respectively, but air cannot pass through the master operator's bypass valve number 72 and the number two operator's bypass valve number 77 while they are in their normally closed position. If one desired for set up purposes to operate only the master operator's valve box for example, one would operate the number two operator's bypass valve 72 changing it to its open position, which would allow air to pass through it no matter in what the position the valves 78, 79 and 80 were, and thus a set up man could set up my entire invention using only set of push buttons on the master operator's box. Such a situation is shown by way of a third bypass valve 108 being in an open position in a number three operator's box which has been added to the drawing to show how flexible my invention is.

Or, for example, when several operator's boxes have already been set up in tooling for a subassembly fixture, and the subassembly is changed, eliminating the need for one or more of the other operator's boxes, the bypass valves can be just set on those boxes and only the operator's boxes can be used, thus adding a great versatility to my invention.

Thus, by abandoning the conventional attempts at solution to the problem of providing a practical valve sequencer, and instead using a new and novel approach, I have developed my automatic programmable valve sequencer which is a great advance in the prior art.

I claim:

1. A system for operating gas controlled devices embodying an automatic programmable valve sequencer adapted to cease operation of said sequencer or said gas controlled devices upon the occurrence of a malfunction, said system including an automatic programmable valve sequencer including in combination a frame member, a valve manifold having at least a first cam valve and a second cam valve mounted on said frame member and being connected to an air supply by a primary conduit, a cam cylinder rotatably mounted adjacent said valve manifold for operating said cam valves, means to mount cam segments to said cam cylinder adjacent each of said cam valves at a predetermined number of positions around the periphery of said cylinder, reversible gas operated means to advance said cylinder through each position of said cylinder, gas operated means to automatically index said cylinder through a predetermined number of positions of said cylinder when programmed to do so, means to program said automatic indexing means, means to reverse the direction of said cam cylinder, said system further including operating means connected to the output of at least said second cam valve, and indicating and shut-off means connected to at least said cam valve to indicate that said operating means are operating correctly and for halting further operation of said valve sequencer and at least said operating means if said operating means are malfunctioning by stopping further operation of said reversible gas operated means, and said indicating means including at least one limit valve having an inlet and a first and a second outlet with said limit valve inlet being connected to a conduit, said conduit also connected to a conduit connecting said second cam valve with the blind end of first and second cylinders, a first shuttle valve, a conduit connecting said first outlet of said limit valve with said shuttle valve, a conduit connected to the output of said shuttle valve, a dumping valve connected to said shuttle valve output conduit with said dumping valve having an outlet and a pilot end A, the outlet of said dumping valve being connected to a conduit, a conduit connecting said outlet of said dumping valve to the pilot end A of a third master operator valve, and a conduit connecting said second output of said limit valve to an indicating valve mounted in the master operator's box.

2. The device defined in claim 1, wherein said means to advance said cam cylinder include an air supply, a conduit connected to said air supply, a lubricator, filter, regulator assembly connected to said conduit, an on-off valve connected to said filter assembly, a reversible ratcheting clutch assembly connected to said cam cylinder, a reversing cylinder operatively connected to said ratchet assembly and connected to said on-off valve, a master operator valve box connected to a reversing valve and to said air supply, an indexing cylinder having a rod end and a blind end, a second indexing valve having a pilot end A and a pilot end B and a first and a second supply inlet and a first and second exhaust outlet with one each of said outlets connected to said rod end and said blind end of said indexing cylinder, a first indexing valve having an input connected to said manifold by means of a conduit and said first indexing valve having a first and second exhaust outlet connected one each to said first and second supply inlets of said second indexing valve and said manifold connected to said air supply by said primary conduit.

3. The device defined in claim 2, wherein said means to automatically index said cylinder through a predetermined number of said positions include a first cam valve mounted on said valve manifold and having a shaft and a cam follower mounted thereon and having a first and a second supply input and a first and a second exhaust outlet and being adapted to be operated by the rotation of said cam cylinder and said cam operating means, the first supply inlet of said first cam valve being connected to said master operator's box, a third indexing valve having a pilot end A and a pilot end B and first supply inlet and a first exhaust outlet with said inlet and said pilot end A being connected to said manifold and said pilot end B being connected to the rod end of said indexing cylinder, and said first exhaust outlet being connected to the pilot end B of said second indexing valve, and a fourth indexing valve having first supply inlet and a first exhaust outlet and a pilot end B and a pilot end A with said inlet and said pilot end A being connected to said manifold and said pilot end B being connected to the blind end of said indexing cylinder and said first exhaust outlet being connected to said second supply inlet of said first cam valve, with the first exhaust outlet of said first cam valve being connected to the pilot end A of said first indexing valve and said second exhaust outlet of said first cam valve being connected to pilot end A of said second indexing valve, all adapted to cause said indexing valve to reciprocate back and forth as long as said first cam valve is actuated by said cam cylinder.

4. The device defined in claim 3, wherein said master operator's box includes a fourth operator's valve having a first and second supply inlet and a first and second exhaust outlet with said first exhaust outlet being connected to said first supply inlet of said first cam valve and said second exhaust outlet being connected to said primary conduit, a third master operator's valve having a first exhaust outlet connected to the first supply inlet of said fourth operator's valve and having a pilot end A and a pilot end B, a second master operator spring-operated valve having a first and a second supply inlet and a first and a second exhaust outlet with said first exhaust outlet being connected to the first supply inlet of said third master operator's valve and said second exhaust outlet being connected to the pilot end B of said third master operator's valve, a first master operator's valve having a first and a second supply inlet and a first and a second exhaust outlet with said first exhaust outlet being connected to the first supply inlet of said second master operator's valve and said second exhaust outlet being connected to said second supply inlet of said second master operator's valve and said first supply inlet connected to said air supply and said second supply inlet connected to said air supply and to said second supply inlet of said fourth master operator's valve and to said second supply inlet of said reversing valve.

5. The device defined in claim 4, wherein said operating means connected to at least said second cam valve include at least a shaft and a cam follower operated by said cam cylinder, said cam valve having a first supply inlet and a first and a second exhaust outlet, a first cylinder and a second cylinder both having rod ends and blind ends with said first exhaust outlet of said second cam valve being connected to the rod end of both of said first and second cylinders, and said second exhaust outlet being connected to the blind end of said first and second cylinders by means of a conduit interposed between said outlets and said cylinders and adapted to operate said cylinders to extend them when said second cam valve is in its normally on position, and to retract said cylinders when said second cam valve is in its normally off position.

6. The device defined in claim 5, and including a second limit valve means having a first and a second inlet and a first and a second outlet with said first inlet of said second limit valve means being connected to the second outlet of said first limit valve means and said second inlet of said second limit valve means being connected to the conduit communicating with the blind end of said second cylinder and said second outlet of said second limit valve means connected to pilot end B of said first shuttle valve and said first exhaust outlet being connected to said indicating device.

7. The device defined in claim 6, and including additional operating means in the form of a third and a fourth cylinder each having rods ends and blind ends, a third cam valve mounted on said valve manifold and having a shaft and a cam follower and being adapted to be operated by the rotation of said cam cylinder and said cam means and having a first inlet and a first and a second outlet with said first inlet being connected to said primary conduit and the first outlet of said third cam valve being connected to the rod end of said third cylinder and the second outlet of said third cam valve being connected to the blind end of said third cylinder by means of a suitable conduit, a power valve having an inlet and a first and a second outlet with said inlet being connected by means of said primary conduit to said air supply and said first outlet of said power valve being connected by means of a suitable conduit to said rod end of said fourth cylinder and said second outlet of said power valve being connected by means of a suitable conduit to said blind end of said fourth cylinder.

8. The device defined in claim 7, with additional means to indicate when said third and fourth cylinders are operating properly being in the form of a third limit valve having an inlet and a first and second outlet and a fourth limit valve having an inlet and a first and second outlet with said inlet of said third limit valve being connected to said conduit connecting said second outlet of said third cam valve to said blind end of said third cylinder, a second shuttle valve having an end A and an end B with said end A being connected to the output of said first shuttle valve and said end B being connected to the first outlet of said third limit valve, said second outlet of said third limit valve being connected to second indicating device mounted in the master operator's box, said inlet of said fourth limit valve being connected both to said blind end of said fourth cylinder and said second outlet of said power valve and said first outlet of said fourth limit valve being connected to a third shuttle valve having an end A and an end B with the end B being connected to the outlet of said second shuttle valve, said outlet of said third shuttle valve being now connected to the inlet of a dumping valve, with the outlet of said dumping valve being connected at least also to the pilot end A of the third master operator valve, the pilot end A of said dumping valve being connected also to the blind end of said reversing cylinder.

9. The device defined in claim 8, and having in addition to a master operator's box a number two operator's box.

10. The device defined in claim 9, wherein said number two operator's box includes a fourth number two operator's valve having a supply inlet and a first and a second exhaust outlet, a third number two operator's valve having a first supply inlet and a second supply inlet and a first exhaust outlet and a pilot end A and a pilot end B, a number two operator's valve having a first supply inlet and a second supply inlet and a number one and a number two exhaust outlet, a first number two operator's spring-loaded valve having a first and a second supply inlet and a first and a second exhaust outlet with the first supply inlet of said fourth number two operator's valve being interposed between the first supply inlet of said number one master operator's valve and said air supply, the first supply inlet of said third number two operator's valve being connected to the number one exhaust outlet of said fourth number two operator's valve, said pilot end A of said third number two operator's valve being interposed between said dumping valve outlet and said pilot end A of said third master operator's valve, said first supply inlet of said number two spring-loaded number two operator's valve being connected to the outlet of said third number two operator's valve, said number two exhaust output of said second number two operator's valve being connected to the pilot end B of said third number two operator's valve, said first exhaust outlet of said first number two operator's valve being connected to the said first supply inlet of said second number two operator's valve and said second exhaust outlet of said first number two operator's valve being connected to said second supply inlet of said second number two operator's valve and said first supply inlet of said first number two operator's valve being connected to said air supply by means of said primary conduit, a bypass conduit also connected to said second inlet of said fourth number two operator's valve and said first supply inlet of said first number two operator's valve, and said first supply inlet of said first number one operator's valve connected to said air supply.

11. The device defined in claim 10, and including a third operator's box.

12. The construction defined in claim 10, wherein said means to program said automatic indexing means include a plurality of types of cam segments adapted to be mounted on said cam cylinder in varying combinations transversely to said cam cylinder at a predetermined number of positions about the periphery thereof.

13. The device defined in claim 12, wherein said means to mount said cam segments to said cam cylinder adjacent each of said cam valves include any suitable fastening means such as screws, bolts, or the like.

14. The device defined in claim 13, wherein said means to reverse the direction of said cam cylinder include said reversing cylinder and a ratcheting assembly connected to said cam cylinder and said double-acting reversing cylinder.

15. The device defined in claim 1, wherein said frame member includes a plurality of long threaded rods having threaded portions at the ends therein securing a top and a bottom plate together in a spaced relationship by means of suitable bolts being attached to said threaded rods.

* * * * *